US010912401B2

(12) United States Patent
Brenner et al.

(10) Patent No.: US 10,912,401 B2
(45) Date of Patent: Feb. 9, 2021

(54) PRODUCT DISPLAYING HOLDER SYSTEMS

(71) Applicant: iSee Store Innovations, L.L.C., St. Louis, MO (US)

(72) Inventors: Steven Allen Brenner, Richmond Heights, MO (US); Mark Schaefer, Town & Country, MO (US); Sesha Madireddi, St. Charles, MO (US); Rushil Eaga, St. Louis, MO (US); Mani Gundala, St. Louis, MO (US)

(73) Assignee: iSee Store Innovations, L.L.C., St. Louis, MO (US)

( * ) Notice: Subject to any disclaimer, the term of this patent is extended or adjusted under 35 U.S.C. 154(b) by 0 days.

(21) Appl. No.: 16/567,314

(22) Filed: Sep. 11, 2019

(65) Prior Publication Data

US 2020/0093285 A1 Mar. 26, 2020

Related U.S. Application Data

(60) Provisional application No. 62/734,375, filed on Sep. 21, 2018.

(51) Int. Cl.

| | |
|---|---|
| ***A47F 5/08*** | (2006.01) |
| ***A47F 5/00*** | (2006.01) |
| ***A47F 7/28*** | (2006.01) |

(52) U.S. Cl.

CPC ..... *A47F 5/08* (2013.01); *A47F 7/283* (2013.01); *A47F 7/285* (2013.01)

(58) Field of Classification Search

CPC .. A47F 5/08; A47F 7/283; A47F 7/285; F16B 47/00

USPC ..... 248/313

See application file for complete search history.

(56) References Cited

U.S. PATENT DOCUMENTS

| | | | | | |
|---|---|---|---|---|---|
| 698,272 | A * | 4/1902 | Glover | B41K 1/58 | 211/39 |
| 1,017,102 | A * | 2/1912 | Kaufman | 248/313 | |
| 1,295,120 | A * | 2/1919 | Carte | A47G 29/24 | 232/41 E |
| 2,190,567 | A * | 2/1940 | Jung | A47F 7/283 | 248/108 |
| 2,657,893 | A * | 11/1953 | Puckert | F16B 47/00 | 248/205.8 |
| 2,940,713 | A * | 6/1960 | Van Dusen | F16B 47/00 | 248/205.8 |
| 3,224,644 | A * | 12/1965 | Davis | B65D 83/267 | 222/162 |
| 3,429,542 | A * | 2/1969 | Fagan | A62C 13/78 | 248/313 |
| 4,133,575 | A * | 1/1979 | Mader | B60J 1/20 | 248/205.8 |

(Continued)

FOREIGN PATENT DOCUMENTS

| | | | | |
|---|---|---|---|---|
| EP | 2708164 A1 * | 3/2014 | ..... | A47F 5/08 |

*Primary Examiner* — Stanton L Krycinski

(74) *Attorney, Agent, or Firm* — The Small Patent Law Group LLC; Joseph M. Butscher

(57) ABSTRACT

A product displaying holder system that is configured to removably secure to a surface of a component includes a base bar including one or more securing mounts, and one or more securing assemblies coupled to the securing mount(s). The securing assemblies are configured to removably secure the product displaying holder system to the surface of the component. One or more product holders are secured to the base bar.

20 Claims, 7 Drawing Sheets

(56) References Cited

U.S. PATENT DOCUMENTS 4,848,714 A * 7/1989 Ziaylek, Jr. ..... A62B 9/04 248/313
4,984,693 A * 1/1991 Belokin, Jr. ..... A47B 96/16 211/88.01
4,991,807 A * 2/1991 Radnich ..... A47K 5/02 248/206.3
D320,536 S * 10/1991 Silbernagel ..... D7/619.1
5,071,100 A * 12/1991 Sweeny ..... A62C 13/78 248/310
5,096,272 A * 3/1992 Belokin, Jr. ..... A47F 3/06 211/90.01
5,104,077 A * 4/1992 Liu ..... F16B 47/00 248/205.8
5,188,325 A * 2/1993 Hilty ..... A47F 7/06 211/30
5,242,063 A * 9/1993 Ericksen ..... A47K 3/281 211/65
5,249,770 A * 10/1993 Louthan ..... A47K 1/09 248/205.2
5,318,262 A * 6/1994 Adams ..... F16B 47/00 248/205.8
5,330,261 A * 7/1994 Bennett ..... A47F 3/0486 211/88.01
5,351,841 A * 10/1994 Belokin ..... A47F 5/08 211/88.01
5,358,128 A * 10/1994 Belokin ..... A47B 73/008 211/75
5,405,112 A * 4/1995 Trethewey ..... F16B 47/00 248/205.8
5,486,044 A * 1/1996 Bennett ..... A47F 3/0486 211/88.01
5,655,673 A * 8/1997 Weterrings ..... A47B 81/00 211/74
5,743,415 A * 4/1998 Smart ..... A45D 20/12 211/70.6
5,913,433 A * 6/1999 Belokin ..... A47F 5/0043 211/75
5,915,573 A * 6/1999 Drower ..... A47F 7/0028 211/120
5,921,403 A * 7/1999 Coffaro ..... A47F 7/06 211/30
6,123,299 A * 9/2000 Zach, Sr. ..... A45D 1/00 248/117.1
6,478,271 B1 * 11/2002 Mulholland ..... F16B 47/00 248/205.8
6,571,967 B2 * 6/2003 Belokin ..... A47F 5/08 211/71.01
6,637,707 B1 * 10/2003 Gates ..... A47B 81/005 211/64
6,666,420 B1 * 12/2003 Carnevali ..... F16B 47/00 248/205.8
6,669,033 B1 * 12/2003 Lian ..... F16B 47/00 211/106
D510,015 S * 9/2005 Hostetler ..... D8/373
7,004,334 B2 * 2/2006 Walsh ..... A47F 7/28 211/75
7,059,482 B2 * 6/2006 Reid ..... A47F 7/163 211/118
7,080,744 B2 * 7/2006 Robertson ..... A47F 3/0486 211/74
7,458,541 B1 * 12/2008 Chang ..... A47K 10/3836 242/591
7,490,727 B2 * 2/2009 Spiers ..... A47F 7/0028 211/70.6
7,708,245 B2 * 5/2010 Woo ..... G09F 7/12 248/205.7
7,850,133 B2 * 12/2010 Carnevali ..... F16B 47/00 248/205.5
7,975,858 B2 * 7/2011 Schneider ..... A47F 5/0043 211/75
8,079,557 B2 * 12/2011 Tu ..... F16B 47/006 248/206.2
8,109,479 B1 * 2/2012 Tsai ..... F16B 47/00 248/205.5
8,807,501 B2 * 8/2014 Chung ..... B25H 3/04 211/70.8
9,135,841 B2 * 9/2015 Ayad ..... G09F 11/02
9,200,667 B1 * 12/2015 Hsu ..... F16M 13/02
9,404,526 B2 * 8/2016 Huang ..... F16B 47/00
9,410,571 B2 * 8/2016 Yang ..... F16B 47/00
9,526,356 B2 * 12/2016 Pichel ..... A47F 3/0486
9,591,931 B1 * 3/2017 Oren ..... F16B 2/245
10,104,986 B2 * 10/2018 Schaefer ..... A47B 73/008
10,244,873 B2 * 4/2019 Brenner ..... A47F 3/0426
10,433,631 B2 * 10/2019 Ohlgart ..... A45D 44/02
10,440,937 B2 * 10/2019 Koskey ..... A01K 15/025
2003/0080078 A1 * 5/2003 Belokin ..... A47F 3/0404 211/88.01
2003/0160060 A1 * 8/2003 Hornblad ..... A47F 5/08 221/256
2003/0209505 A1 * 11/2003 Belokin ..... A47F 5/08 211/75
2003/0222037 A1 * 12/2003 Belokin ..... A47F 5/0043 211/75
2004/0099624 A1 * 5/2004 Hein ..... B25H 3/04 211/89.01
2006/0043036 A1 * 3/2006 Robertson ..... F16B 12/00 211/75
2007/0152120 A1 * 7/2007 Hostetler ..... B63C 11/22 248/206.3
2008/0006592 A1 * 1/2008 Brooks ..... A47F 5/0846 211/89.01
2008/0308693 A1 * 12/2008 Kim ..... B65D 51/242 248/205.8
2009/0211123 A1 * 8/2009 Arnold ..... F16B 47/00 40/1
2009/0224117 A1 * 9/2009 Kaneda ..... F16B 47/00 248/206.3
2009/0266779 A1 * 10/2009 Cresswell ..... A47F 7/283 211/119.004
2010/0148025 A1 * 6/2010 Belokin ..... A47F 5/0807 248/206.2
2014/0374552 A1 * 12/2014 Zhong ..... F16B 47/00 248/205.5
2014/0374553 A1 * 12/2014 Park ..... F16B 47/00 248/205.5
2015/0240862 A1 * 8/2015 Shi ..... F16B 47/00 248/205.8
2015/0250333 A1 * 9/2015 Schaefer ..... A47B 73/008 211/89.01
2015/0369276 A1 * 12/2015 Balmer ..... F16M 13/022 248/205.8
2016/0201714 A1 * 7/2016 Zhang ..... F16B 47/00 248/206.2
2016/0215813 A1 * 7/2016 Huang ..... A47G 25/0607
2019/0254253 A1 * 8/2019 Koskey, Jr. ..... F16M 11/041

* cited by examiner

PRODUCT DISPLAYING HOLDER SYSTEMS

RELATED APPLICATIONS

This application relates to and claims priority benefits from U.S. Provisional Patent Application No. 62/734,375 entitled "Product Displaying Holder Systems" filed Sep. 21, 2018, which is hereby incorporated by reference in its entirety.

FIELD OF EMBODIMENTS OF THE DISCLOSURE

Embodiments of the present disclosure generally relate to product displaying holder systems, such as may be used to reliably hold, secure, and display beverage containers in a variety of positions or orientations within a refrigerated cooler, for example.

BACKGROUND OF THE DISCLOSURE

Various commercial enterprises offer goods for sale that may be contained within a transparent container. For example, various convenience stores offer refreshments for sale. Some of the refreshments, such as soft drinks, alcoholic beverages, and the like, are refrigerated. Often, the refreshments are contained within a refrigerated compartment having a transparent door (formed of, for example, glass). The transparent door allows a customer to see the types of soft drinks that are available for sale. If the customer chooses to purchase a particular soft drink, the customer opens the door, removes a soft drink within the refrigerated compartment, and then closes the door.

The space within a refrigerated compartment is limited. As such, each refrigerated compartment is able to contain a limited number of products. A known refrigerated compartment includes multiple shelves on which various products are positioned. When the shelf space is fully occupied by product, additional products are not able to be positioned within the refrigerated compartment. Instead, as products within the refrigerated compartment are removed by customers, additional product may then be moved into the open space on the shelf.

As can be appreciated, the additional product that is not within the refrigerated compartment is stored at other areas of an establishment, thereby taking up valuable space. Further, if a large number of products are removed from the refrigerated compartment, the additional products that are used to replenish the refrigerated compartment take time to cool to a desirable temperature.

SUMMARY OF THE DISCLOSURE

A need exists for a system and method of accommodating and displaying increased numbers of products within a display container, such as a refrigerated compartment.

With that need in mind, certain embodiments of the present disclosure provide a product displaying holder system that is configured to removably secure to a surface of a component. The product displaying holder system includes a base bar including one or more securing mounts, and one or more securing assemblies coupled to the securing mount (s). The securing assemblies are configured to removably secure the product displaying holder system to the surface of the component. One or more product holders are secured to the base bar.

The base bar may include a front face connected to a supporting ledge. The front face is configured to be parallel to the surface of the component, and the supporting ledge is configured to be perpendicular to the surface of the component. In at least one embodiment, each of the securing assemblies includes a suction cup and a suction securing nut. Optionally, the product holders may snapably secure to the base bar. In at least one embodiment, the product holders may include a lower panel connected to an arcuate front cuff, and arcuate arms extending from an upper end of the front cuff. One or more clips may extend from a lower surface of the lower panel. The clips are securely retained by one or more reciprocal features of the base bar. In at least one embodiment, an identification sign is configured to securely clip to the base board.

Certain embodiments of the present disclosure provide a product displaying holder system configured to removably secure to a surface of a component. The product displaying holder system has a base bar including one or more securing mounts, and one or more securing assemblies coupled to the one or more securing mounts. The one or more securing assemblies are configured to removably secure the product displaying holder system to the surface of the component. The product displaying holder system also includes one or more product holders secured to the base bar. Each of the one or more product holders includes a lower panel connected to an arcuate front cuff, arcuate arms extending from an upper end of the front cuff, and an identification sign removably secured to the baseboard.

Optionally, the base bar includes at least one support tab extending from the base bar and configured to engage the surface of the component when at least one securing assembly of the one or more securing assemblies is secured to the surface of the component. In one aspect, the base bar includes at least one mounting channel, and the identification sign includes at least one mounting tab that is configured to secure the identification sign to the base bar when the at least one mounting tab is disposed through the mounting channel.

In another aspect, the base bar includes a supporting ledge and a lower ledge with a rib element extending between the supporting ledge and lower ledge to support the base bar. In an example, at least one of the one or more securing assemblies is received against a splined surface of at least one of the one or more securing mounts. In another aspect, each of the one or more securing assemblies comprises a suction cup and a suction securing nut. In yet another aspect, one or more clips extend from a lower surface of the lower panel, and the one or more clips are securely retained by one or more reciprocal features of the base bar.

Certain embodiments of the present disclosure also provide a product displaying holder system configured to removably secure to a surface of a component. The product displaying holder system has a base bar including one or more securing mounts, and one or more securing assemblies coupled to the one or more securing mounts. The one or more securing assemblies are configured to removably secure the product displaying holder system to the surface of the component. The product displaying holder system also includes one or more product holders secured to the base bar, and an identification sign removably secured to the baseboard.

Optionally, the base bar includes at least one support tab extending from the base bar and configured to engage the surface of the component when at least one securing assembly of the one or more securing assemblies is secured to the surface of the component. The base bar may also include at least one mounting channel, and the identification sign includes at least one mounting tab that is configured to secure the identification sign to the base bar when the at least one mounting tab is disposed through the mounting channel. In one aspect, the base bar includes a supporting ledge and a lower ledge with a rib element extending between the supporting ledge and lower ledge to support the base bar. In one example, at least one of the one or more securing assemblies is received against a splined surface of at least one of the one or more securing mounts. In another aspect, each of the one or more securing assemblies comprises a suction cup and a suction securing nut.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Figure 1:
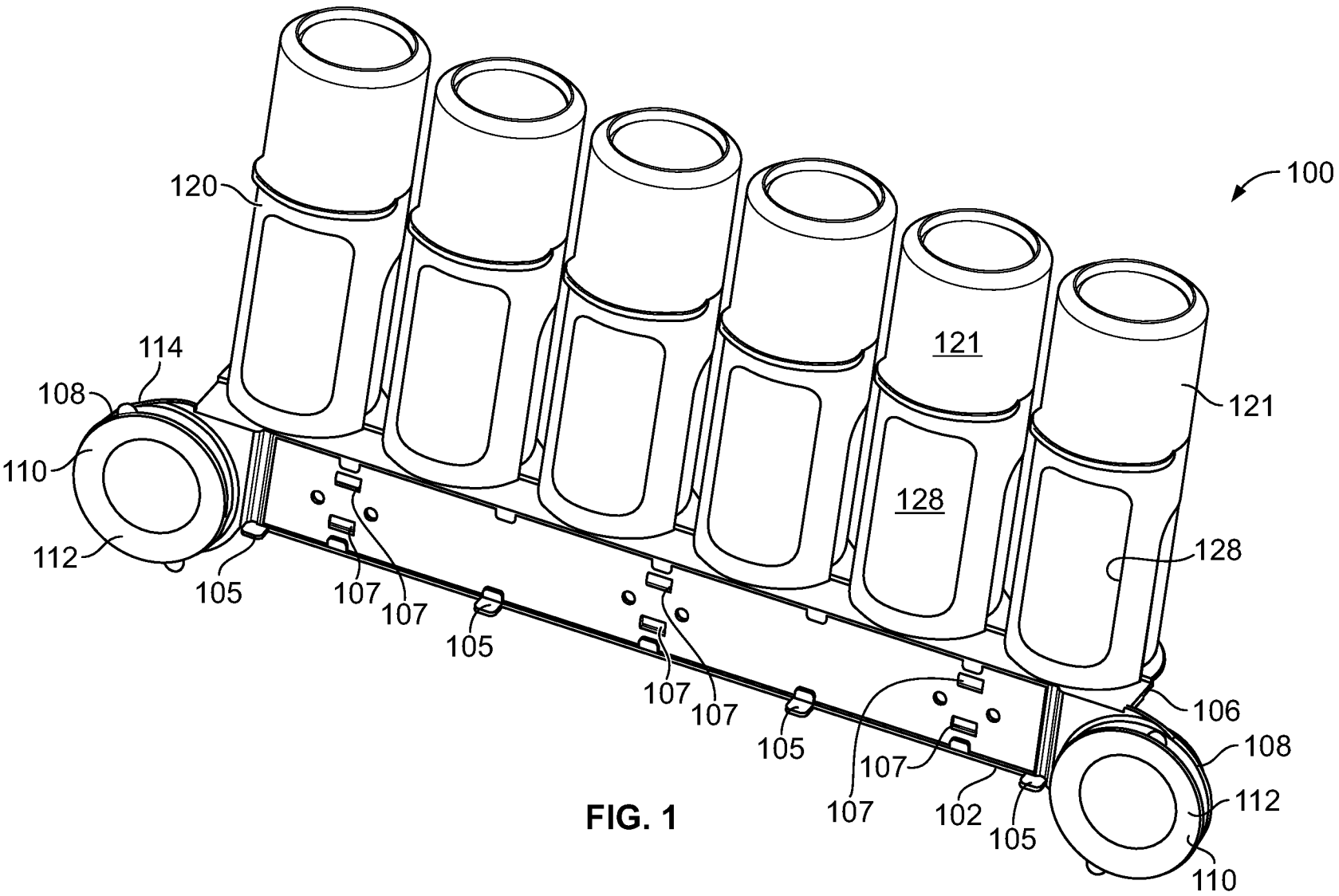
FIG. 1 illustrates a perspective front view of a product displaying holder system retaining beverage containers, according to an embodiment of the present disclosure.
Figure 3:
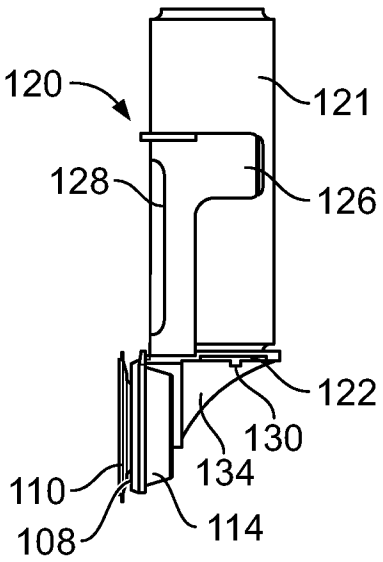
FIG. 3 illustrates a lateral view of the product displaying holder system retaining a beverage container, according to an embodiment of the present disclosure.
Figure 2:
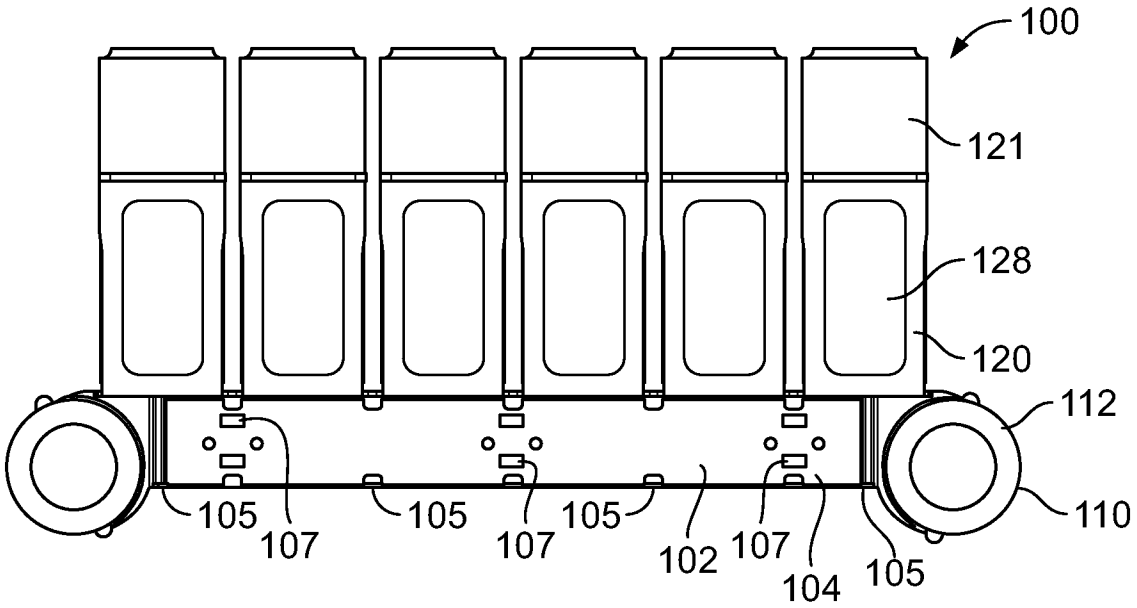
FIG. 2 illustrates a front view of the product displaying holder system retaining beverage containers, according to an embodiment of the present disclosure.
Figure 4:
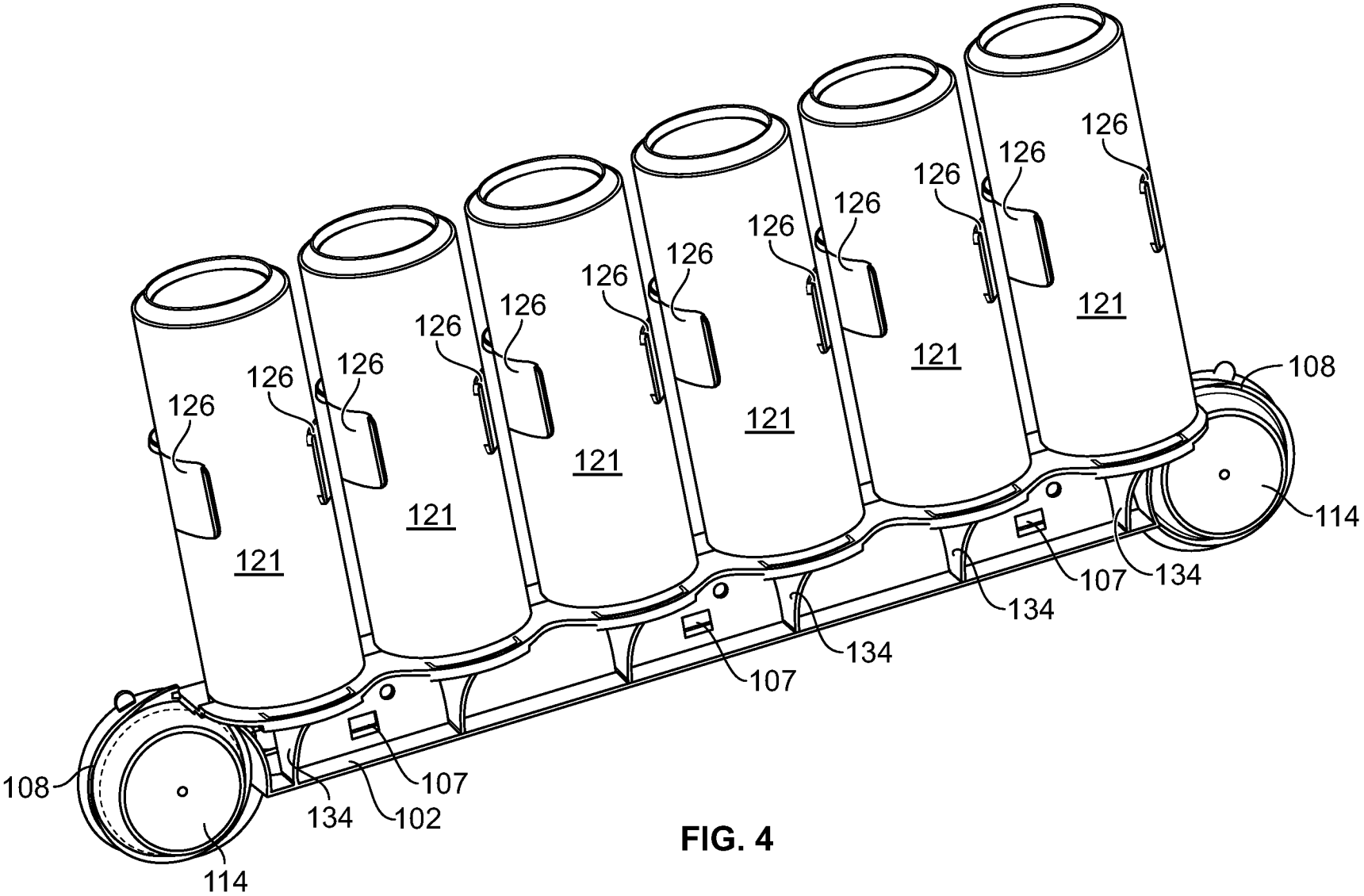
FIG. 4 illustrates a perspective rear view of the product displaying holder system retaining beverage containers, according to an embodiment of the present disclosure, according to an embodiment of the present disclosure.
Figure 5:
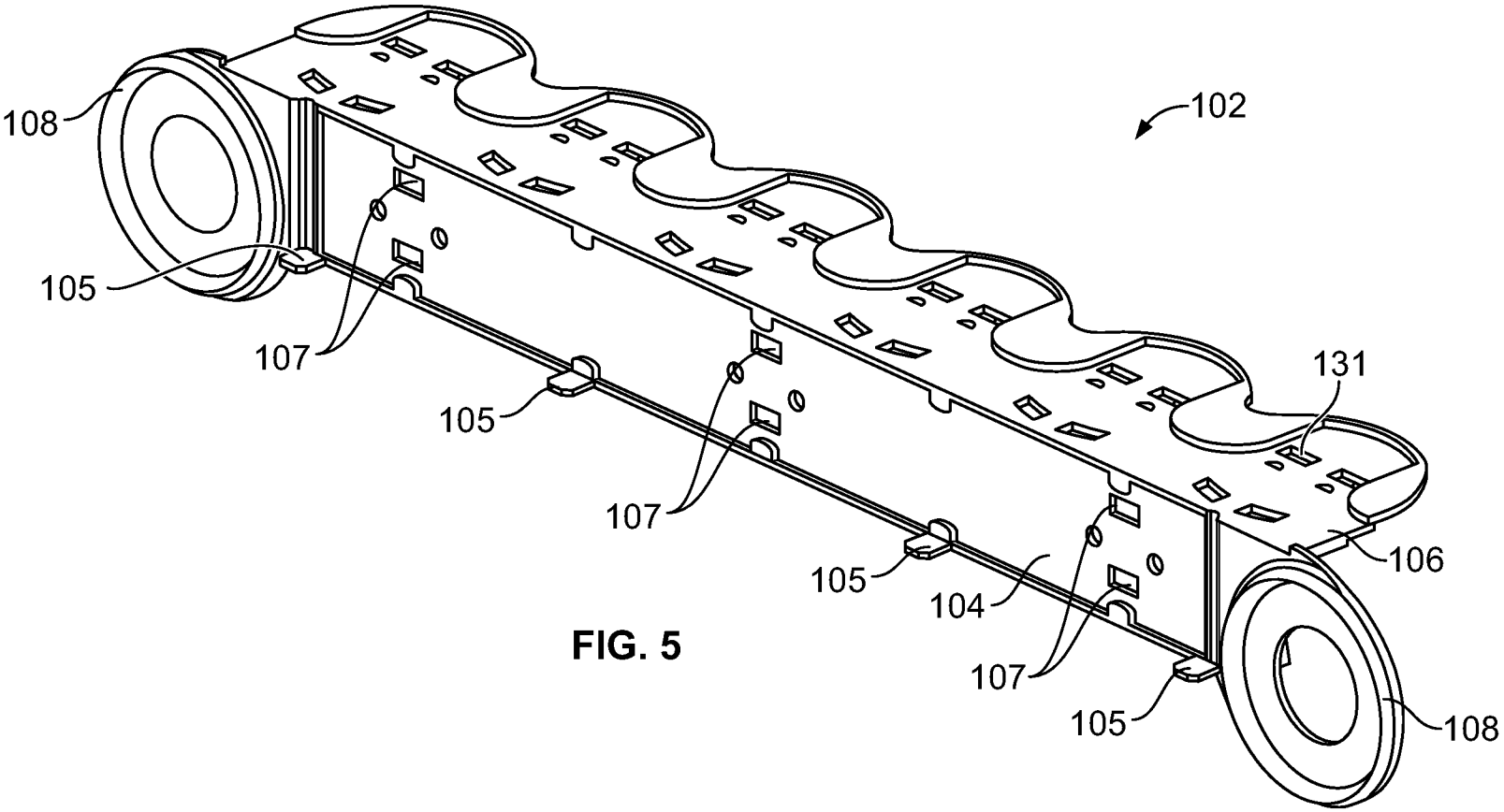
FIG. 5 illustrates a perspective front view of a base bar, according to an embodiment of the present disclosure.
Figure 6:
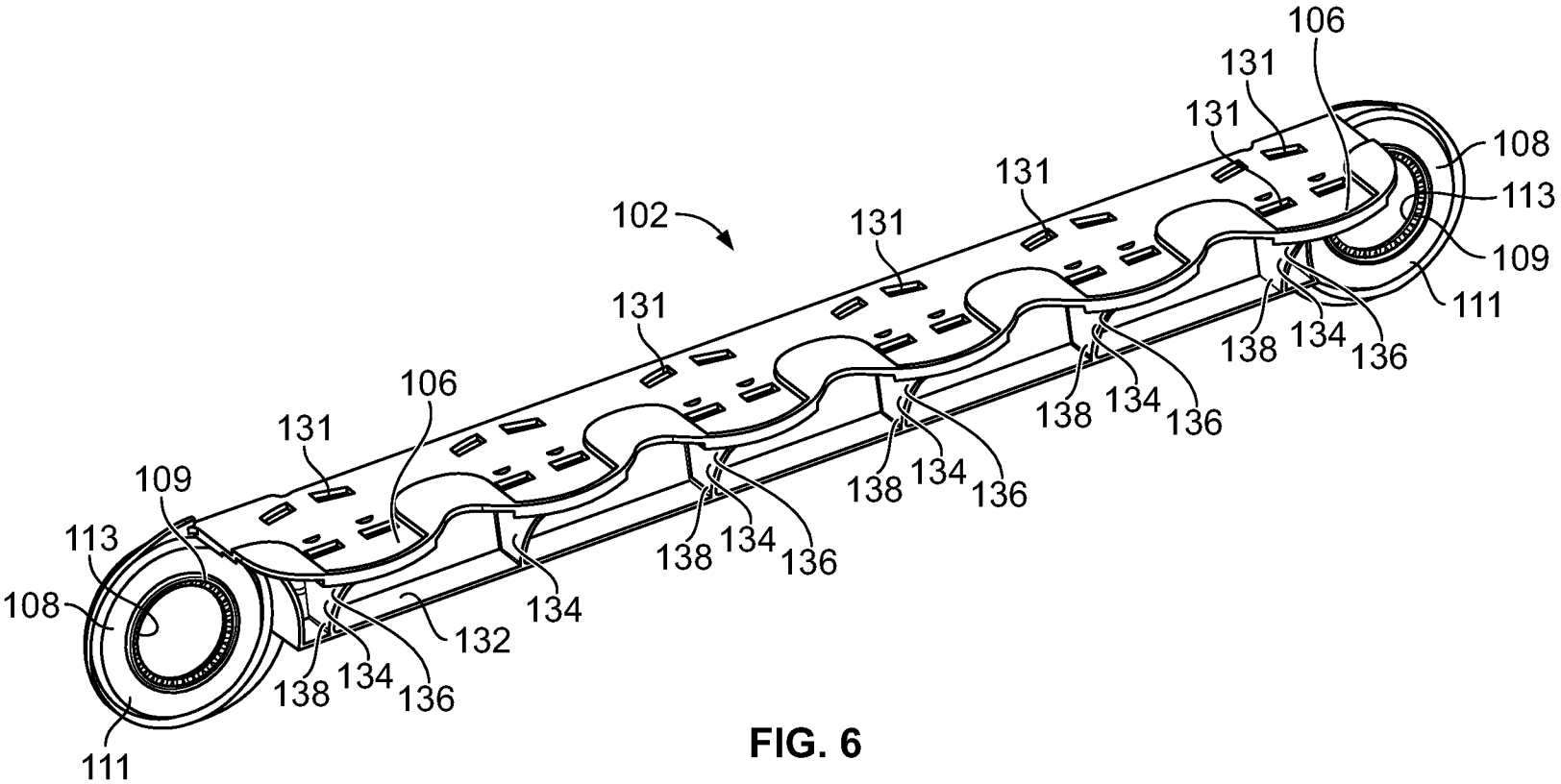
FIG. 6 illustrates a perspective rear view of a base bar, according to an embodiment of the present disclosure.

FIG. 1 illustrates a perspective front view of a product displaying holder system retaining beverage containers. FIG. 2 illustrates a front view of the product displaying holder system retaining beverage containers. FIG. 3 illustrates a lateral view of the product displaying holder system retaining a beverage container. FIG. 4 illustrates a perspective rear view of the product displaying holder system retaining beverage containers. FIG. 5 illustrates a perspective front view of a base bar. FIG. 6 illustrates a perspective rear view of a base bar.

Referring to FIGS. 1-6, the product displaying holder system 100 includes a base bar 102 including a front face 104, a supporting ledge 106, and one or more securing mounts 108. The front face 104 and the supporting ledge 106 may be perpendicular to one another. For example, the front face 104 may be configured to be vertically oriented and parallel to a surface of a component (such as a glass door) to which the product displaying holder system 100 couples, while the supporting ledge 106 is configured to be horizontally oriented.

The front face 104 may include support tabs 105 that extend orthogonal from the front face 104. The support tabs 105 extend away from the front face 104 a distance that is not greater than the distance suction cups 112 extend when in a non-suction position. When the suction cup 112 provides a suction coupling with a component such as a door, the support tabs 105 are of size and shape to engage the door.

While four evenly spaced support tabs 105 are illustrated in this example, in other examples only 1, or more then 10 support tabs 105 are presented. Similarly, in other examples the support tabs 105 are not evenly spaced. Additionally, while illustrated being relatively square in shape, in other examples one or more support tabs are elongated across the front face 104 including an embodiment where a single one-piece support tab extends the length of the front face between the securing mounts 108. In each instance, the support tab(s) provides structural support to the product displaying holder system 100 by engaging the surface of the component coupled to the suction cups 112 of the securing mounts 108.

Figure 7:
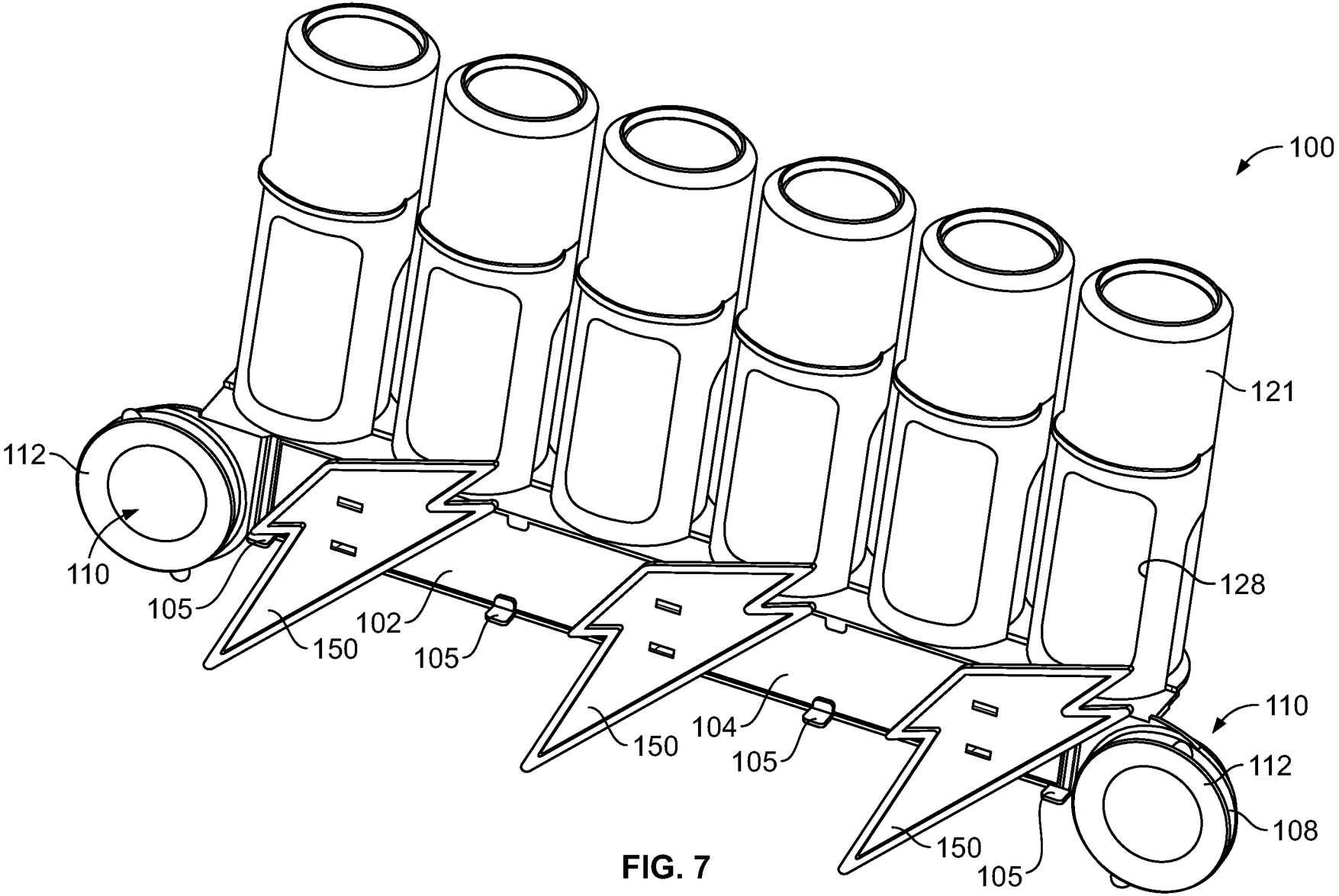
FIG. 7 illustrates a perspective front view of a product displaying holder system retaining beverage containers, according to an embodiment of the present disclosure.

In another example, the front face 104 includes mounting channels 107 that may receive mounting tabs of an identification sign (FIGS. 7-8) or other display or advertising structure. As illustrated, in three separate locations on the front face 104, sets of mounting channels 107 are provided. As a result, an identification sign may have two spaced apart mounting tabs that each insert into a corresponding channel 107 to secure the identification sign to the base bar 102. In this manner, three separate identification signs may be secured to the base bar (FIG. 7). Alternatively, a single identification sign with six mounting tabs that correspond to the six channels 107 may be provided for a single advertisement or display.

Securing mounts 108 may be at opposite ends of the base bar 102. Each securing mount 108 is configured to retain a securing assembly 110, which may include a suction cup 112 and a suction securing nut 114. Examples of the securing assemblies 110 are described in U.S. patent application Ser. No. 14/623,679, entitled "Systems and Methods for Securing and Displaying Products," filed Feb. 17, 2015, and U.S. patent Ser. No. 16/052,822, entitled "Securing Assembly," filed Aug. 2, 2015, both of which are hereby incorporated by reference in their entireties. The product displaying holder system 100 may include more or less securing mounts 108 and securing assemblies 110 than shown. In the example embodiment of FIGS. 1-6 the securing mount 108 includes a splined surface 109 combined with a thickened body 111 surrounding the opening 113 that receives the suction cup 112 and securing nut 114. As a result, additional support is provided at the securing mounts 108.

The base bar 102 securely retains one or more product holders 120 that hold product 121. The product holders 120 are configured to removably retain products, such as beverage containers. The product holders 120 may be snapably secured to the supporting ledge 106. For example, the supporting ledge 106 may include one or more channels that are configured to conforming clips of the product holders 120. The base bar 102 may be shorter or longer than shown. For example, the base bar 102 may be configured to retain more or less product holders 120 than shown. The product 121 may include cans of varying height and diameter, boxes, bottles, or the like to be held in place by the product holders 120.

The product holder 120 includes a lower panel 122 connected to an arcuate front cuff 124. Arcuate arms 126 extend from an upper end of the cuff 124. The product holder 120 is configured to retain beverage container (such as a can or bottle) is between the arms 126, the cuff 124, and the lower panel 122.

As shown, an opening 128 may be formed through the front cuff 124. The opening 128 reduces the amount of material (such as plastic) that is used to form the product holder 120, thereby reducing material weight and cost. Optionally, the front cuff 122 may be contiguous without an opening, which may provide a clearer, more consistent view (unobstructed by boundaries formed by the opening 128) of a beverage container, particularly when the product holder 120 is formed of a transparent plastic, for example.

One or more clips 130 extend from a lower surface of the lower panel 122. The clips 130 are configured to be received and snapably retained within reciprocal structures 131 such as slots or other such channels formed in the supporting ledge 106 of the base bar 102. The connection interface may include more or less clips 130 than shown. In one example, as illustrated in FIG. 6, the reciprocal structures 131 may be rectangular slots wherein for a set of four rectangular slots that receive the clips 130 of a product holder 120, a back pair of rectangular slots are angled compared to the base bar 102, and the front part are aligned and parallel to the base bar 102. By providing the reciprocal structures 131 in this manner, the strength of the connection between the product holder 120 and base bar 102 is enhanced. In yet another example, the product holder 120 may include a semi-circular clip portion that connects and couples within the semi-circular opens also illustrated in FIG. 6, to provide additional support. Additionally, the semi-circular shape prevents the product holder 120 from being coupled to the base bar 102 in an incorrect orientation, or from backing out of position because the flat side of the semi-circular clip portion locks against the mating flat surface. Therefore, a one-way attachment with improved functionality is presented.

In the example embodiment of FIGS. 1-6, the base bar 102, in addition to the supporting ledge 106, includes a lower ledge 132 and plural rib elements 134, or braces, that extend between the supporting ledge 106 and the lower ledge 132. In one example the plural rib elements 134 are spaced evenly across the base bar 102, while in other example embodiments the plural rib elements 134 are unevenly spaced across the base bar 102. In one such example a stress test is performed on the base bar 102 when loaded with a predetermined product 121 and the rib elements 134 are placed where the most load is experienced along the base bar 102. Specifically, the rib elements 134 provide additional structural support to the base bar 102.

In one example as illustrated in FIGS. 4 and 5, each rib element 134 extends from a first end 136 that engages or is part of the supporting ledge 106 and extends to a second end 138 that engages or is part of the lower ledge 132. The first end 136 in this embodiment is wider than at the second end 138 and the rib element 134 arcuately tapers from the wider first end 136 to the narrower second end 138, again, to provide additional structural support when loaded with product 121.

Figure 8:
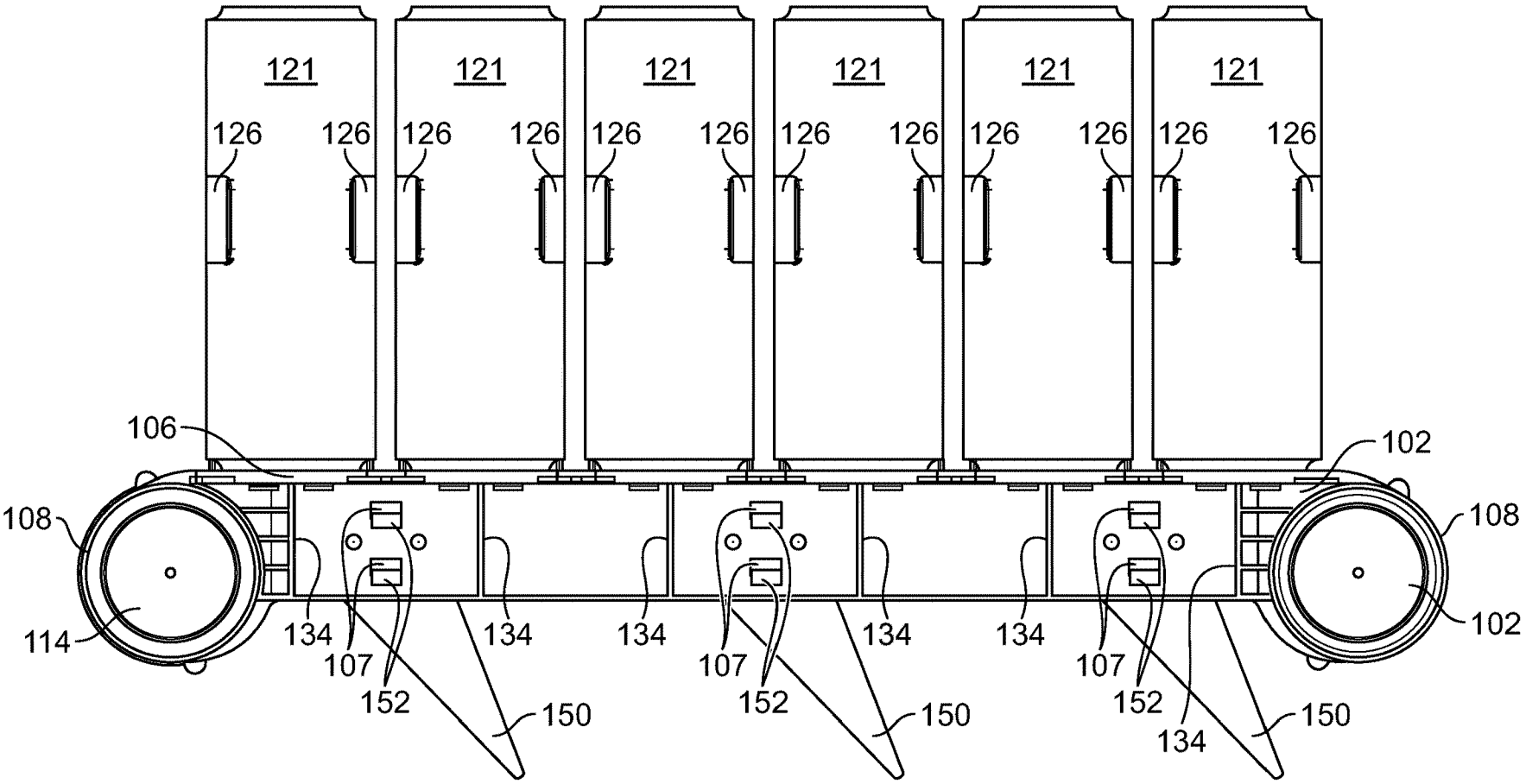
FIG. 8 illustrates a plan rear view of a product displaying holder system retaining beverage containers, according to an embodiment of the present disclosure.

FIG. 7 illustrates a product displaying holder system retaining beverage containers. FIG. 8 illustrates a product displaying holder system also retaining beverage containers.

Referring to FIGS. 7-8, an identification sign 150, that is a unique product or brand identifier, is attached on the front face 104. In particular, each identification sign 150 includes mounting tabs 152 that may be inserted into the mounting channels 107 to secure the identification sign 150 to the base bar 102. In one example the mounting tabs include ramped surfaces that push the mounting tabs 152 together as they are being inserted through the mounting channel 107 and expand, snapping into place after existing the mounting channel 107 on the other side of the base bar 102. In this manner the mounting tabs 152 may be squeezed together to allow removal of the identification sign 150 when desired. In another example, the identification sign 150 is permanently clipped to the base bar 102, and the identification sign 150 may not be removed. Numerous identification signs 150 may be produced for various products, modularly secured to the base bar 102, and deter non-associated products from being displayed on the product displaying holder system 100 having a unique identification sign 150 that identifies a specific product, brand, or the like.

Referring to FIGS. 1-8, the product displaying holder systems provide a rack mounting display that provides a full view of the beverage containers. The product holders 120 may be resilient and deflectable to securely retain the beverage containers. For example, the arms 126 may resiliently bias into the beverage containers to provide a firm and secure hold and eliminate, minimize, or reduce product rattling. The identification signs 150 provide unique clip-on badges that ensure that the product displaying holder systems remain associated with particular products, brands, and/or the like. Thus, not only do the product displaying holder systems provide additional storage for containers within existing refrigerator devices, the product displaying holder system provide an additional functionality of presenting advertising and display material for the containers.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A product displaying holder system configured to removably secure to a surface of a component, the product displaying holder system comprising:

a base bar including a front face, a supporting ledge extending from the front face, and one or more securing mounts, wherein the supporting ledge includes one or more channels;

one or more securing assemblies coupled to the one or more securing mounts, wherein the one or more securing assemblies are configured to removably secure the product displaying holder system to the surface of the component; and one or more product holders snapably secured to the supporting ledge, wherein the one or more product holders include one or more clips that are retained within the one or more channels.

2. The product displaying holder system of claim 1, wherein the front face is configured to be parallel to the surface of the component, and the supporting ledge is configured to be perpendicular to the surface of the component.

3. The product displaying holder system of claim 1, wherein each of the one or more securing assemblies comprises a suction cup and a suction securing nut.

4. The product displaying holder system of claim 1, wherein each of the one or more product holders comprises:

a lower panel connected to an arcuate front cuff; and arcuate arms extending from an upper end of the front cuff.

5. The product displaying holder system of claim 4, wherein the one or more clips extend from a lower surface of the lower panel.

6. The product displaying holder system of claim 1, further comprising an identification sign that is configured to securely clip to the base bar.

7. A product displaying holder system configured to removably secure to a surface of a component, the product displaying holder system comprising:

a base bar including a front face, a supporting ledge extending from the front face, and one or more securing mounts, wherein the supporting ledge includes one or more channels;

one or more securing assemblies coupled to the one or more securing mounts, wherein the one or more securing assemblies are configured to removably secure the product displaying holder system to the surface of the component;

one or more product holders secured to the base bar, wherein the one or more product holders comprises:

one or more clips that retained within the one or more channels;

a lower panel connected to an arcuate front cuff; and arcuate arms extending from an upper end of the front cuff; and an identification sign removably secured to the baseboard.

8. The product displaying holder system of claim 7, wherein the base bar includes at least one support tab extending from the base bar and configured to engage the surface of the component when at least one securing assembly of the one or more securing assemblies is secured to the surface of the component.

9. The product displaying holder system of claim 7, wherein the base bar includes at least one mounting channel, and the identification sign includes at least one mounting tab that is configured to secure the identification sign to the base bar when the at least one mounting tab is disposed through the mounting channel.

10. The product displaying holder system of claim 7, wherein the base bar includes a lower ledge, wherein a rib element extends between the supporting ledge and lower ledge.

11. The product displaying holder system of claim 7, wherein at least one of the one or more securing assemblies is received against a splined surface of at least one of the one or more securing mounts.

12. The product displaying holder system of claim 7, wherein each of the one or more securing assemblies comprises a suction cup and a suction securing nut.

13. The product displaying holder system of claim 7, wherein the one or more clips extend from a lower surface of the lower panel.

14. A product displaying holder system configured to removably secure to a surface of a component, the product displaying holder system comprising:

a base bar including a front face, a supporting ledge extending from the front face, one or more securing mounts, and at least one mounting channel, wherein the supporting ledge includes one or more channels;

one or more securing assemblies coupled to the one or more securing mounts; and one or more product holders secured to the supporting ledge, wherein the one or more product holders include one or more clips that are retained within the one or more channels; and an identification sign removably secured to the front face of the base bar, wherein the identification sign includes at least one mounting tab that is configured to secure the identification sign to the base bar when the at least one mounting tab is disposed through the mounting channel.

15. The product displaying holder system of claim 14, wherein the base bar includes at least one support tab extending from the base bar and configured to engage the surface of the component when at least one securing assembly of the one or more securing assemblies is secured to the surface of the component.

16. The product displaying holder system of claim 14, wherein the base bar includes a lower ledge, wherein a rib element extends between the supporting ledge and lower ledge.

17. The product displaying holder system of claim 14, wherein at least one of the one or more securing assemblies is received against a splined surface of at least one of the one or more securing mounts.

18. The product displaying holder system of claim 14, wherein each of the one or more securing assemblies comprises a suction cup and a suction securing nut.

19. A product displaying holder system configured to removably secure to a surface of a component, the product displaying holder system comprising:

a base bar including a front face, a supporting ledge extending from the front face, and one or more securing mounts, wherein the supporting ledge includes one or more channels;

one or more securing assemblies coupled to the one or more securing mounts, wherein the one or more securing assemblies are configured to removably secure the product displaying holder system to the surface of the component; and one or more product holders secured to the supporting ledge, wherein the one or more product holders include one or more clips that are retained within the one or more channels, wherein each of the one or more product holders comprises a lower panel connected to an arcuate front cuff, and arcuate arms extending from an upper end of the front cuff.

20. The product displaying holder system of claim 19, wherein the one or more clips extend from a lower surface of the lower panel.

* * * * *